United States Patent [19]

Agergård et al.

[11] Patent Number: 4,674,143

[45] Date of Patent: Jun. 23, 1987

[54] SWEEPING APPARATUS

[75] Inventors: Gösta Y. Agergård, Karlstad; Bengt A. R. Fernström, Hammarö, both of Sweden

[73] Assignee: Stiga Aktiebolag, Tranas, Sweden

[21] Appl. No.: 830,942

[22] Filed: Feb. 19, 1986

Related U.S. Application Data

[63] Continuation of Ser. No. 712,602, Mar. 18, 1985, Pat. No. 4,602,400.

[30] Foreign Application Priority Data

Mar. 16, 1984 [SE] Sweden ..... 8401471

[51] Int. Cl.[4] ..... E01H 1/04

[52] U.S. Cl. ..... 15/79 A; 15/83; 180/19.2

[58] Field of Search ..... 15/79 R, 79 A, 83, 82, 15/84, 50 C, 49 C, 340; 51/176; 280/19.2; 37/241-243, 285; 56/201

[56] References Cited

U.S. PATENT DOCUMENTS

| | | | |
|---|---|---|---|
| 2,194,297 | 3/1940 | Drumm | 15/83 |
| 2,263,722 | 11/1941 | Drumm | 15/83 |
| 2,834,034 | 5/1958 | Angell | 15/79 A |
| 2,941,223 | 6/1960 | Klauer | 15/79 A |
| 4,393,537 | 7/1983 | Reprogle et al. | 15/79 A X |

*Primary Examiner*—Edward L. Roberts

*Attorney, Agent, or Firm*—Murray and Whisenhunt

[57] ABSTRACT

The invention concerns a sweeping apparatus of the kind comprising a manually operated carriage (1) with at least one pair of rear wheels (3, 4) and at least one front wheel (5, 47) and a power operated rotatable brush cylinder (14). The brush cylinder is carried by and journalled in a yoke (21) or corresponding element, which is mobile with respect to the carriage and constitutes or is a part of a front lever arm of a double lever (37), the rear lever arm of which is made up of or is a part of the manually operated handle (28, 44) of the carriage, said lever being hinged to the carriage (1) with a horizontal first turning axis (36) and permitting the brush cylinder to be raised or lowered with respect to the surface to be swept and the pressure of the brush against said surface to be adjusted by means of said handle by moving said double lever about said horizontal first turning axis.

6 Claims, 5 Drawing Figures

SWEEPING APPARATUS

This is a continuation application of Ser. No. 712,602, filed Mar. 18, 1985, now U.S. Pat. No. 4,602,400.

TECHNICAL FIELD

The invention relates to a sweeping apparatus of the kind comprising a manually handled carriage with at least one pair of rear wheels and at least one front wheel and a power operated cylindrical sweeping brush.

BACKGROUND ART

Sweeping devices of the kind mentioned above are known in a number of designs. Reference is made to the following patent disclosures: U.S. Pat. Nos. 2,834,034; 2,933,748; 3,087,180, and 3,354,489. Prior art also includes, see for example U.S. Pat. No. 2,933,748, the possibility of moving the brush cylinder between an upper disengaged position and a lower working position. The known devices, however, do not allow the operator to adjust without difficulty the pressure of the brush against the surface to be swept or to make the brush follow an uneven surface. The known devices fail, for example, to provide for the possibility of sweeping a depression in the surface between the front and rear wheels of the sweeping apparatus.

There have been presented sweepers, the rotatable brush of which can be made to pivot about a vertical axis, thereby allowing for so called diagonal sweeping, changing the angle between the brush axis and the carriage is a complicated procedure, however, and the devices intended for diagonal sweeping have a complex construction.

In order to compensate to some degree for the fact that the brush cannot follow the swept surface if the surface is uneven, some known devices increase the pressure of the brush against the surface. As a consequence, however, the sweeping resistance increases correspondingly. If said resistance is also increased by the weight and/or the resistance of the sweepings, the result of the sweeping often becomes unsatisfactory. This is true for example when the surface to be swept is wet, or when wet snow or leaves or the like is to be removed.

DISCLOSURE OF THE INVENTION

The object of the invention is to provide a sweeping apparatus, which is superior to the known, comparable devices in the respects mentioned above. Specifically, an object is to provide a sweeping apparatus, the rotatable brush of which directly by the operator can be made to follow the contours of the swept surface. The sweeping apparatus of the invention is easily handled and generally simple to drive. Another advantage and object of the invention is to provide a sweeper for both dry and wet sweeping. A further object according to a preferred embodiment of the sweeping apparatus is to make possible the adaptation of the apparatus for so called diagonal sweeping, leftwards or rightwards as desired. Yet another purpose is to provide a machine which cannot reverse and run over the operator, if he or she should fall.

These and other objects of the invention may be realized by an apparatus in accordance with the appended patent claims.

Further objects and advantages of the invention will be made apparent from the following description of a preferred embodiment.

BRIEF DESCRIPTION OF THE DRAWINGS

In the following description of a preferred embodiment, reference will be made to the accompanying drawings, in which.

DESCRIPTION OF A PREFERRED EMBODIMENT

Figure 1:
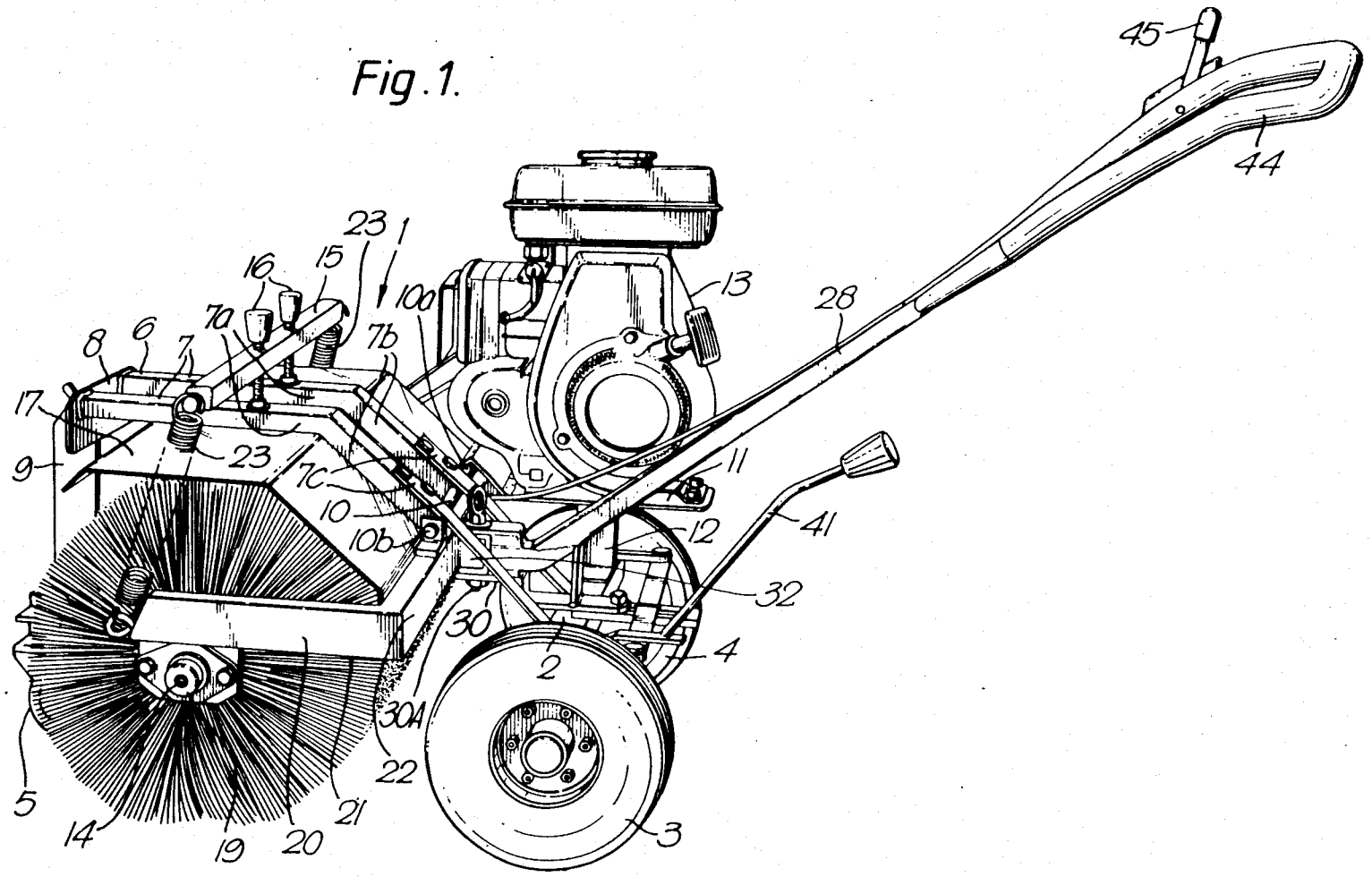
FIG. 1 is a perspective view of the sweeper as viewed from the left side thereof.

In the drawings, a carriage or carriage unit has been designated by numeral 1. This carriage unit 1 consists of the following main parts: a rear axle 2 with a pair of rear wheels 3 and 4, a front caster 5, and a framework 6, connecting the rear axle 2 to the front caster 5. The framework 6 comprises two parallel frame beams 7, extending from a vertical front plate 8 horizontally rearwards with parts *7a*, further at an angle downwards rearwards with parts *7b*, said parts *7b* being connected rigidly to the rear axle by rigid bars *7c*. The caster 5 is connected to the plate 8 by a vertical detachable leg 9. The two frame parts 7 are connected to each other partly by the front plate 8 and the rear axle 2, partly by a horizontal bar 10 near the lowest rearward end of the frame parts *7b*, and partly by a splash guard 17 underneath the frame parts *7a* and *7b*. The bar 10 extends toward the right side of the apparatus with a part 10*a*, which supports a horizontal plate 11, and toward the left side of the apparatus with a pin 10*b*. The plate 11 is also supported by a pair of feet 12 on the rear axle 2, and on it is mounted a motor 13 for a cylindrical brush 14. To the carriage unit belongs also a horizontal beam 15 situated somewhat above the horizontal frame parts *7a*. The beam 15 extends clear across the breadth of the apparatus. The position of the beam 15 relative to the frame parts *7a* is adjustable by means of a pair of set screws 16.

Figure 2:
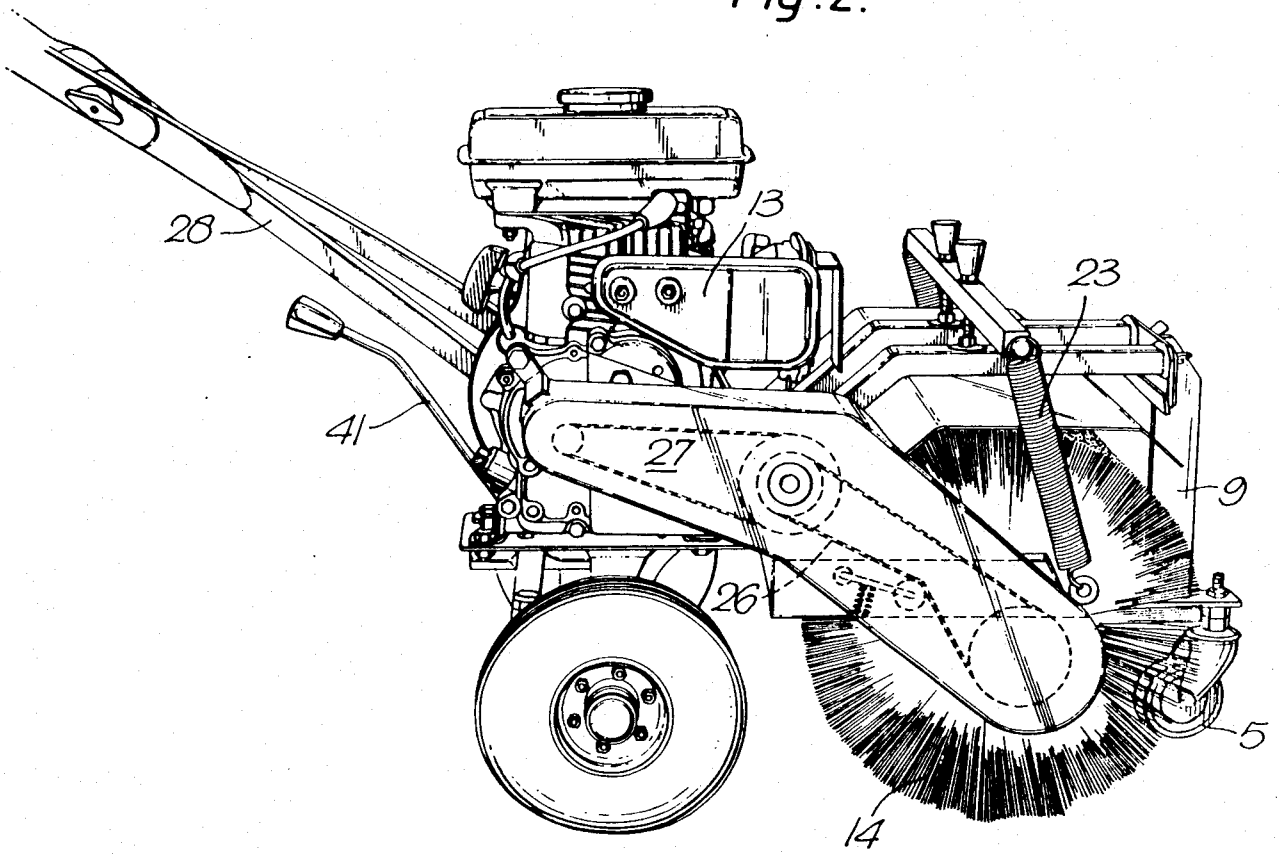
FIG. 2 is a view of the apparatus from its right side.

The shaft 18 of the cylindrical brush 14 is journalled at both ends in bearings 19 on the legs 20 of a yoke or fork 21. The back 22 of the yoke 21 is parallel to the rear axle 2. The front ends of said legs 20 are suspended from the beam 15 by springs 23. The yoke 21 is pivotally attached to the frame 7 by means of braces 24 through which extend the pin 10*b* and the extended end 10*a* of bar 10, near the lowest, rearward ends of frame parts *7b*. In other words, the bar 10, 10*a*, and 10*b* together with the braces 24 form a horizontal first hinge, the horizontal axis of which has been designated 36. The brush cylinder 14 can be made to rotate about the shaft 18 by the motor 13 via a chain or belt drive 26 which is protected by a cover 27, see FIG. 2.

The yoke 21 is connected to a shaft 28 via a vertical, second hinge 29 between the legs of a fork 30 directed forwards, being a part of the shaft 28. The hinge 29 is formed by a rearwards directed projection 32 on the back part 22 of the yoke 21, the fork 30 and a vertical fork pin 30A extending through the fork 30 and the projection 32. From the fork 30 an extension 31 points directly rearwards and from the bottom side of the extension 31 a pin or rod 33 points downwards at a right angle. The pin 33 extends through an elongated slot 34 in a plate 35 on a parallel tie bar 38. The plate 35 rests on and slides against the top side of the rear axle 2. The shaft 28, the grip handle 44, and the yoke 21 together form a double lever, which can be turned about the horizontal turning axis 36, which coincides with the centre axis of the bar 10. The rear lever arm in other words consists of the shaft 28 with the grip handle 44 together with the fork 30, while front lever arm consists of the yoke 21, or, to be precise, the legs 20 of the yoke 21.

Figure 4:
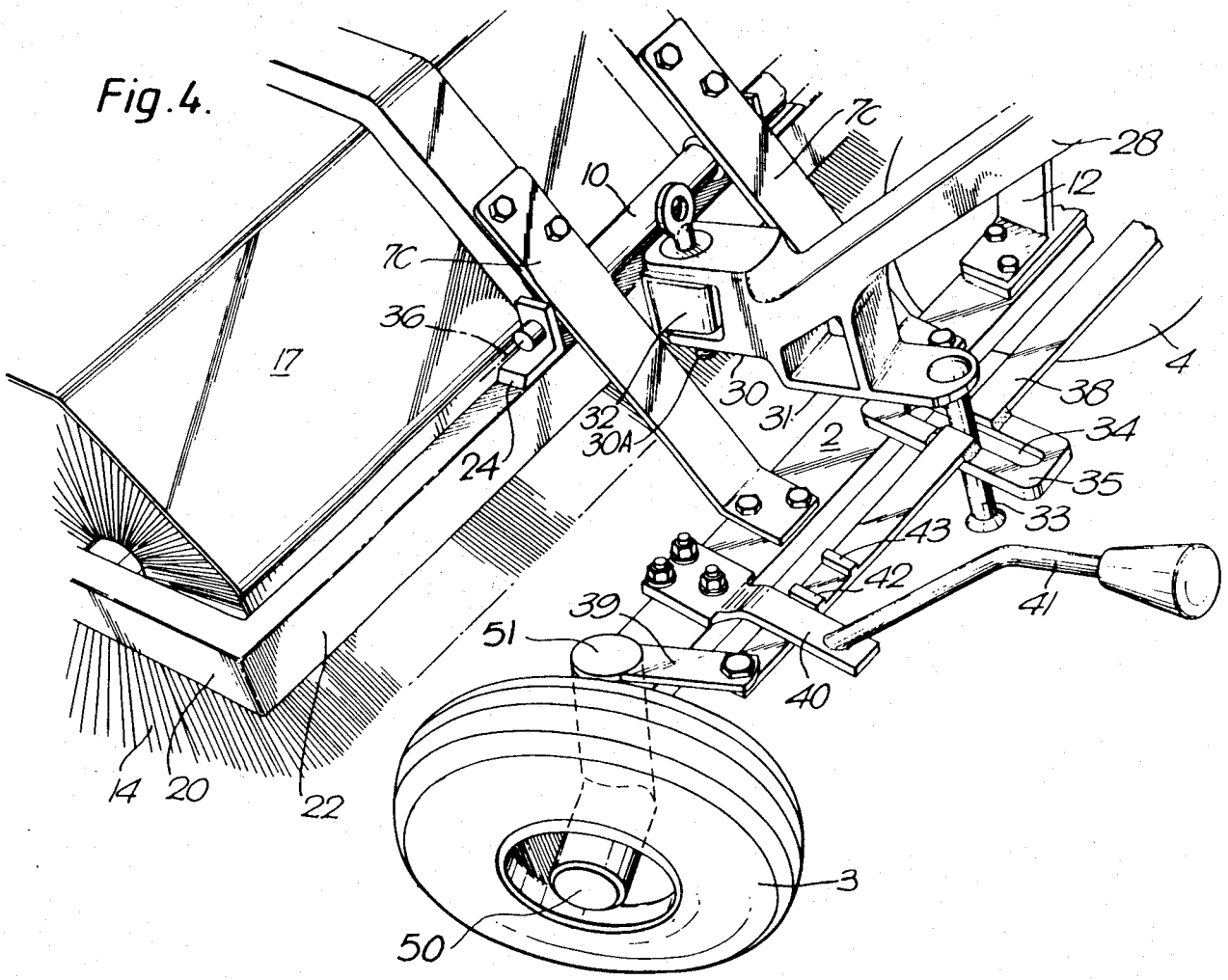
FIG. 4 illustrates in greater detail a pair of hinges of the apparatus and a mechanism for changing-over of the sweeper to diagonal sweeping.
Figure 5:
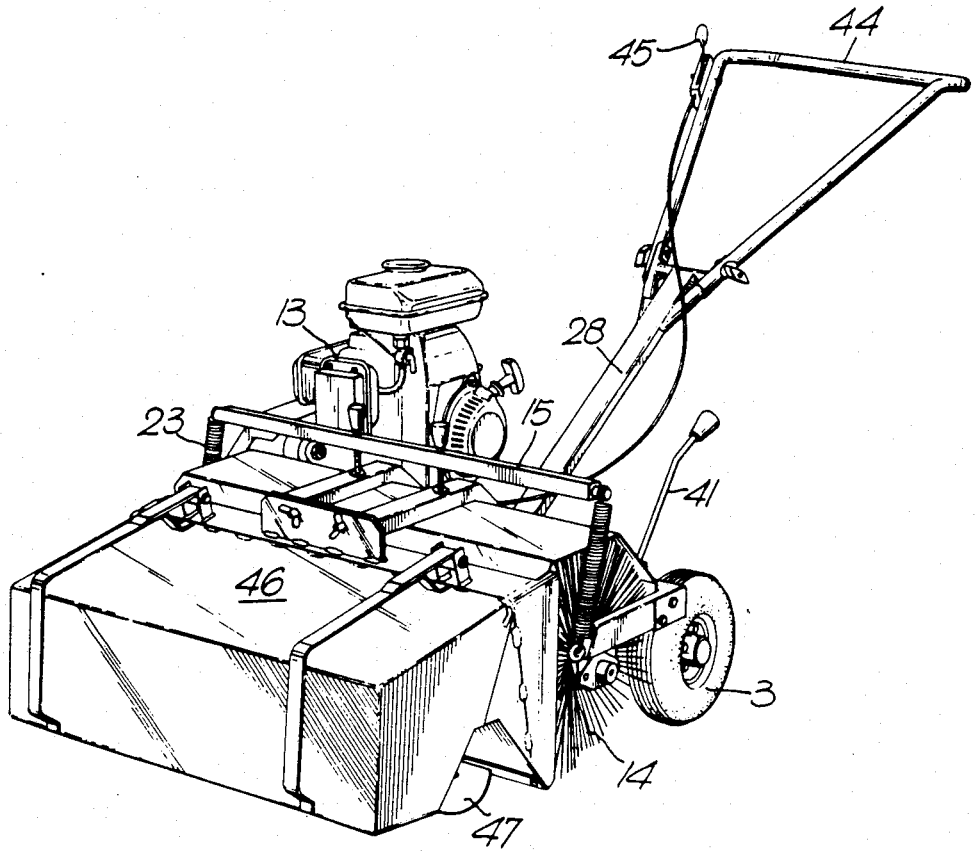
FIG. 5 is a perspective view of the sweeping apparatus equipped with a collector for sweepings, as viewed from the front side of the apparatus.

The tie rod 38, which is parallel to the rear axle 2, comprises a pair of links 39 at its two ends, with which to turn the vertical steering shaft 51, which can be turned about its vertical axis of rotation, so as to cause a corresponding movement of horizontal wheel axle 50, attached thereto, and thereby turn the rear wheels 3 and 4 in parallel in the conventional manner by displacing the tie rod 38 sideways. This parallel turning is accomplished by means of the shaft 28, as it is turned about the hinge 29, the turning movement of the extension 31 being transmitted to the tie rod 38 via the pin 33, the slot 34 and the plate 35, thus causing the tie rod to move in sideways as desired. To make possible this movement, however, a stop bar 40 with spring action must first be lifted by means of a lever 41, thus freeing the stop bar 40 from its locking position on the tie rod 38. There are three locking positions, as determined by two elevations 42 and 43 on the rod. In the position according to FIG. 4 the stop bar 40 is placed to the left of the left elevation 42. This position corresponds to a fixed brush position for diagonal sweeping directed forwards rightwards. In the other extreme position the stop bar 40 is located to the right of the right elevation 43, corresponding to diagonal sweeping in the forward leftward direction. In the normal position, the brush sweeping straight ahead, the locking bar is put between the two elevations 42 and 43. In other words, the locking bar 40 and the elevations 42 and 43 on the tie rod provide for three fixed positions for the brush cylinder and the yoke 21 relative to the shaft 28: a leftward position, a normal position in which the shaft 28 is symmetrical with respect to the yoke 21, and a rightward position. All three positions permit the shaft to be raised or lowered in its vertical plane, about the horizontal axis of the hinge 10.

Figure 3:
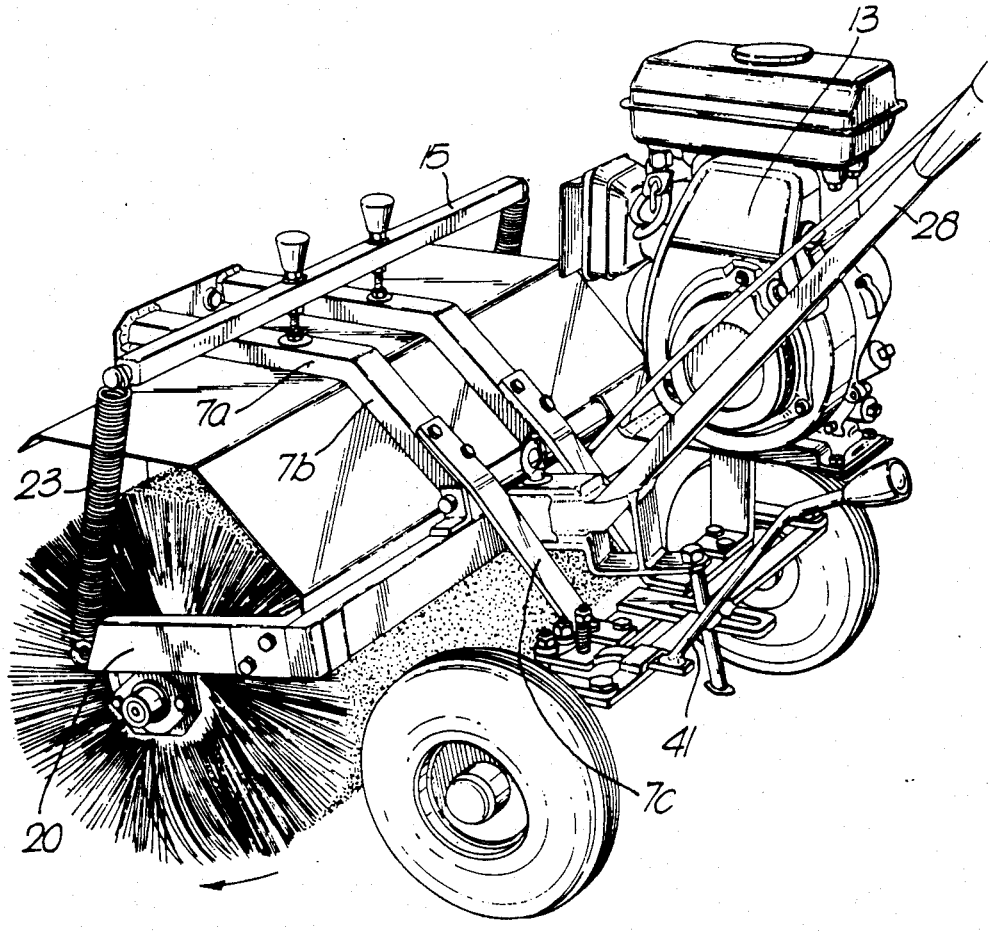
FIG. 3 shows how the brush may be pressed down toward the swept surface.

When the sweeping apparatus is in motion, the motor 13 turns the cylindrical brush 14 and the apparatus is moved and steered manually by means of the grip handle 44, which is an extension of the shaft 28. On the grip handle is also situated the throttle lever 45 for the motor 13. When the sweeper is in motion the stop bar 40 is pressed down into one of the described locking positions. By raising or lowering the grip handle 44 the operator may turn the double lever about the horizontal axis 36. The front part of the double lever, in other words the yoke legs 20, will be inclined downwards, as in FIG. 3, or upwards, as the rear part of lever 37 is raised or lowered, respectively, whereby the brush is raised from or lowered against the swept surface. In this manner, the pressure of the brush 14 against the surface to be swept may be increased or decreased and/or the brush be made to follow any elevations or depressions of the surface. The the apparatus is used on a flat surface the weight of the yoke 21 and the brush 14 is counteracted by the springs 23. The spring action may also be adjusted by means of the set screws 16. If the operator lets go of the grip handle 44, the brush 14 is automatically lifted by the springs 23. Thus, the apparatus is hindered from reversing, being propelled by the rotating brush, and hurting the operator, should he or she fall down.

The sweeping apparatus may also be provided with a collecting bin 46 for sweepings. According to this embodiment, the bin 46 is equipped with two wheels 47, replacing the swivel wheel 5. The bin 46 is mounted onto the plate 8, after first detaching the leg 9 and the swivel wheel 5 mounted thereto.

We claim:

1. Sweeping apparatus for sweeping a surface comprising a manually handled carriage, at least one pair of parallel rear wheels and at least one swivelable front wheel connected to the carriage, said at least one swivelable front wheel swivelable about a vertical axis, and at least one power operated sweeping brush having a horizontal axis and located between said front and rear wheels, a rear axle member connected to the carriage and carrying the rear wheels, said rear axle member being parallel to said brush axis, and disposition means for disposing said rear wheels either at an angle or perpendicularly relative to the brush axis without changing the parallel nature of the rear axle member relative to the brush axis.

2. Apparatus of claim 1, further including a manually operated handle, and locking means for locking the handle in any one of at least three vertical planes, one plane coinciding with a vertical plane perpendicular to the brush axis, and the other vertical planes being disposed at an angle thereto.

3. Apparatus of claim 2, including a hinge means, having an axis perpendicular to the rear axle member, for permitting the handle to be moved relative to the carriage about the hinge means axis, said handle cooperating with said disposition means to transmit the motion of the handle about the hinge means axis to the rear wheels to cause the rear wheels, while remaining parallel to each other, to be directed at an angle or perpendicularly to the brush axis to permit diagonal sweeping or normal sweeping respectively.

4. Apparatus of claim 3, wherein said disposition means includes a tie rod assembly interacting with the rear wheels and a link assembly connecting the handle to the tie rod assembly.

5. Apparatus of claim 4, wherein said locking means locks said tie rod assembly in a selected one of at least three relatively fixed positions, with the positions corresponding to rear wheel positions perpendicular to the brush axis, angled to the right of the brush axis, and angled to the left of the brush axis.

6. Apparatus of claim 2 further including a double-armed lever, said handle constituting one lever arm of said double-armed lever, with the second lever arm of the double-armed lever having the sweeping brush mounted thereon.

* * * * *